US007513407B1

(12) United States Patent
Chang

(10) Patent No.: US 7,513,407 B1
(45) Date of Patent: Apr. 7, 2009

(54) COUNTERFORCE-COUNTERACTING DEVICE FOR A NAILER

(75) Inventor: Chin-Hsiun Chang, Daya Township, Taichung County (TW)

(73) Assignee: Acuman Power Tools Corp., Taichung (TW)

( * ) Notice: Subject to any disclaimer, the term of this patent is extended or adjusted under 35 U.S.C. 154(b) by 12 days.

(21) Appl. No.: 11/858,850

(22) Filed: Sep. 20, 2007

(51) Int. Cl.
*B25C 5/00* (2006.01)

(52) U.S. Cl. ..... 227/132; 227/131; 173/202; 173/211

(58) Field of Classification Search ..... 227/8, 227/10, 120, 132, 131; 173/211, 202, 49, 173/210, 120, 203
See application file for complete search history.

(56) References Cited

U.S. PATENT DOCUMENTS 1,877,162 A * 9/1932 Day ..... 227/137
3,042,924 A * 7/1962 Frostad ..... 227/120
3,305,156 A * 2/1967 Khan ..... 227/132
3,847,322 A * 11/1974 Smith ..... 227/132
4,121,745 A * 10/1978 Smith et al. ..... 227/8
4,215,808 A * 8/1980 Sollberger et al. ..... 227/146
4,530,454 A * 7/1985 Gloor et al. ..... 227/129
4,724,992 A * 2/1988 Ohmori ..... 227/146
4,807,793 A * 2/1989 Ghibely ..... 227/131
5,320,270 A * 6/1994 Crutcher ..... 227/131
5,927,585 A * 7/1999 Moorman et al. ..... 227/132
6,604,666 B1 * 8/2003 Pedicini et al. ..... 227/131
6,971,567 B1 * 12/2005 Cannaliato et al. ..... 227/2
6,997,367 B2 * 2/2006 Hu ..... 227/132
7,011,243 B2 * 3/2006 Mochizuki ..... 227/131
7,134,585 B2 * 11/2006 Schiestl et al. ..... 227/9
7,275,673 B2 * 10/2007 Zahner et al. ..... 227/10

* cited by examiner

*Primary Examiner*—Scott A. Smith
(74) *Attorney, Agent, or Firm*—Banger Shia

(57) ABSTRACT

A counterforce-counteracting device for a nailer comprises an active device, a rotating member, and a weight device. The active device drives the rotating member and the weight device to move. After the active device moves, the weight device is driven by the rotating member to produce a counterforce, so as to counteract the counterforce of the nailer. Thereby, such a device is secure and is easy to assemble.

7 Claims, 5 Drawing Sheets

COUNTERFORCE-COUNTERACTING DEVICE FOR A NAILER

BACKGROUND OF THE INVENTION

1. Field of the Invention

The present invention relates to a counterforce-counteracting device for a nailer, and more particularly to a counterforce-counteracting device for a nailer which can counteract the counterforce and is secure since an active device drives a rotating member to move, and then the rotating member moves a weight device to produce a counterforce to counteract the counterforce produced by the active device.

2. Description of the Prior Art

Currently, conventional electric nailers are not disposed with any device for counteracting the counterforce. When in use, the counterforce of the nailer may hurt the user. Thereby, buffer cushions or other buffer devices are disposed in the nailer, but such buffer devices still have some disadvantages. Therefore, an electric nailer with the function of adjusting the impact force disclosed in TW Pat. serial number 093135323 is developed, which comprises a spring and an elastic adjusting device and serves to adjust and control the buffer force. However, such a structure not only has a complex design and high cost, but also is insecure, and the effect of counteracting the counterforce is not ideal.

The present invention has arisen to mitigate and/or obviate the afore-described disadvantages.

SUMMARY OF THE INVENTION

The primary objective of the present invention is to provide a counterforce-counteracting device for a nailer which comprises an active device, a rotating member and a weight device. The active device drives the rotating member to move, and then the rotating member moves the weight device. After the active device of the nailer moves, the rotating member and the weight device will produce a counterforce to counteract the counterforce of the nailer, such that the present invention is secure and is easy to assemble.

The second objective of the present invention is to provide a counterforce-counteracting device for a nailer which comprises an active device, a rotating member, a weight device, and a buffer member. The active device drives the rotating member to move, and then the rotating member moves the weight device. After the active device moves, the weight device is driven by the rotating member, such that the active device and the weight device can be used to produce a counterforce. In addition, the buffer member is used to abut against the weight device to produce the buffering effect again. Thereby, the present invention not only has double buffering effect, but also is secure and is easy to operate.

The third objective of the present invention is to provide a counterforce-counteracting device for a nailer which comprises an active device, a rotating member, a weight device, and a second elastic member. After the active device of the nailer moves, the weight device is driven by the rotating member, such that the active device and the weight device can be used to produce a counterforce. And after the second elastic member produces a push force after having performed the striking motion, the weight member of the weight device will produce an inertia force opposite to the push force. In addition, the push force produced by the second elastic member can reduce the loss of the inertia force of the weight member of the weight device. Thereby, the present invention is secure and can hit the nail stably.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
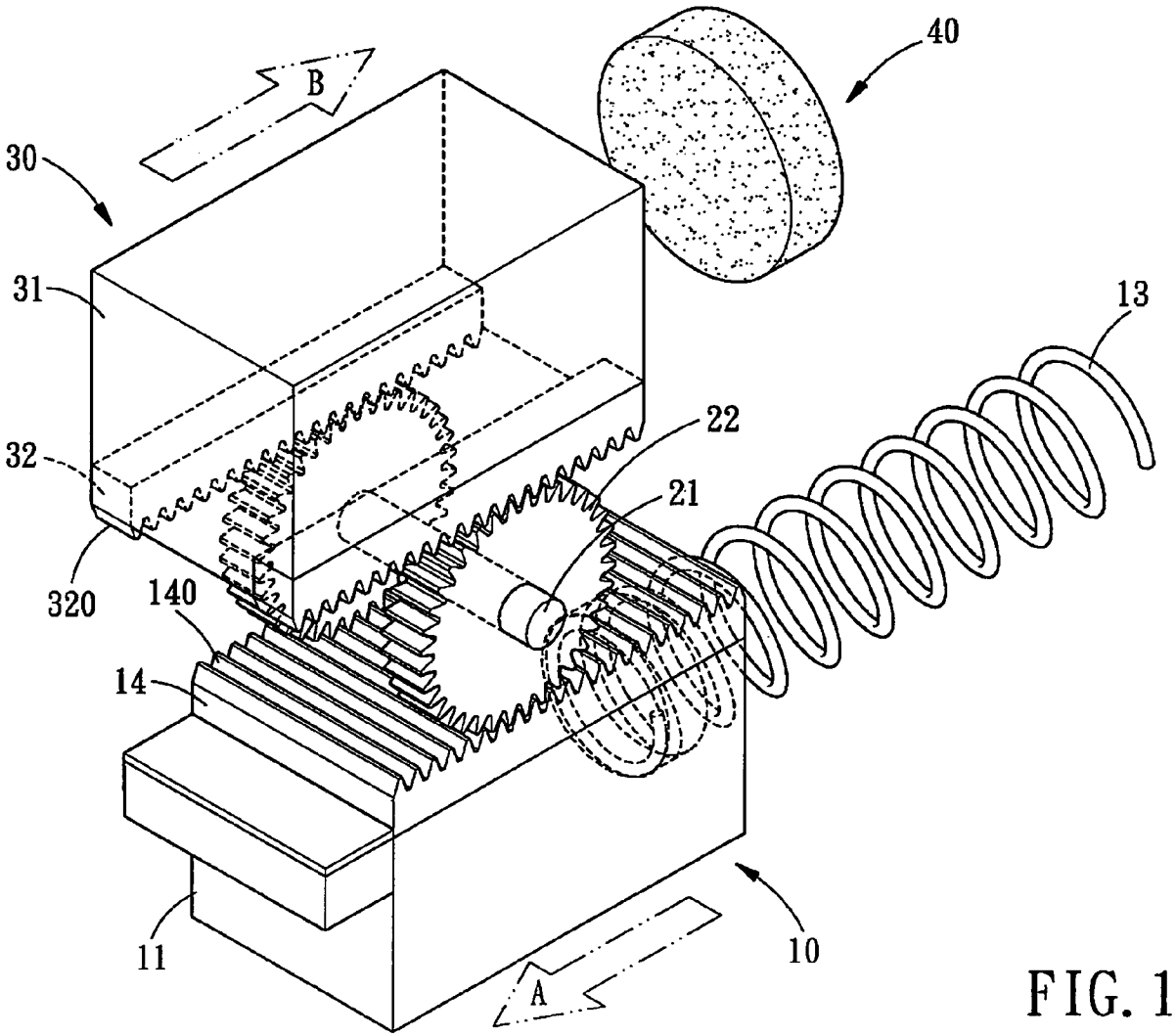
FIG. 1 is a perspective view of a counterforce-counteracting device for a nailer in accordance with a first embodiment of the present invention.

Referring to FIGS. 1-4, a counterforce-counteracting device for a nailer in accordance with the present invention comprises an active device 10, a rotating member 20, a weight device 30 and a buffer member 40. The active device 10 drives the rotating member 20 to move, and then the rotating member 20 moves the weight device 30. After the active device 20 moves, the active device 10 and the weight device 30 are directly driven by the rotating member 20 to produce a counterforce, and the buffer member 40 is used to abut against the weight device 30 to produce a buffering effect, such that the present invention not only has a buffering effect, but also is secure and is easy to operate.

The active device 10 is disposed in the nailer and includes a rectangular-shaped active member 11, a pin-shaped nail-hitting member 12, a coil-shaped first elastic member 13, and at least one rectangular-shaped first driving member 14. The active member 11 is disposed in the nailer. The nail-hitting member 12 is located at one end of the active member 11 close to a muzzle of the nailer and is provided for hitting the nail into the work piece, and the other end of the active member 11 is formed with a containing portion 110 for receiving one end of the first elastic member 13. The other end of the first elastic member 13 is abutted against the inside of the nailer. The first driving member 14 is located at one end of the active member 11 facing the rotating member 20, and there can be one or more first driving members 14. In addition, the first driving member 14 is formed with a notched first driving portion 140 which serves to drive the rotating member 20 to move.

The rotating member 20 is a circular-shaped wheel and includes a pivot member 21 and an annular-notched engaging portion 22. The pivot member 21 is inserted into the rotating member 20 from one side of the nailer, and the rotating member 20 is rotated around the pivot member 21. The engaging portion 22 is rotated by the first driving portion 140 of the first driving member 14 of the active member 11 and then drives the weight device 30 to move.

The weight device 30 includes a rectangular-shaped weight member 31 and a rectangular-shaped second driving member 32. The weight member 31 is disposed in one end of the nailer close to the rotating member 20, and the second driving member 32 is located at one side of the weight member 31 close to the rotating member 20. The second driving member 32 is formed with a notched second driving portion 320 for engaging with the engaging portion 22 of the rotating member 20.

The buffer member 40 is made of flexible material that can absorb shock and stress, such as soft pad, plastic, rubber, or cork. The buffer member 40 is disposed in the nailer and located close to the weight member 31 of the weight device 30, and the weight member 31 is abutted against the buffer member 40 to produce a counterforce.

Figure 2:
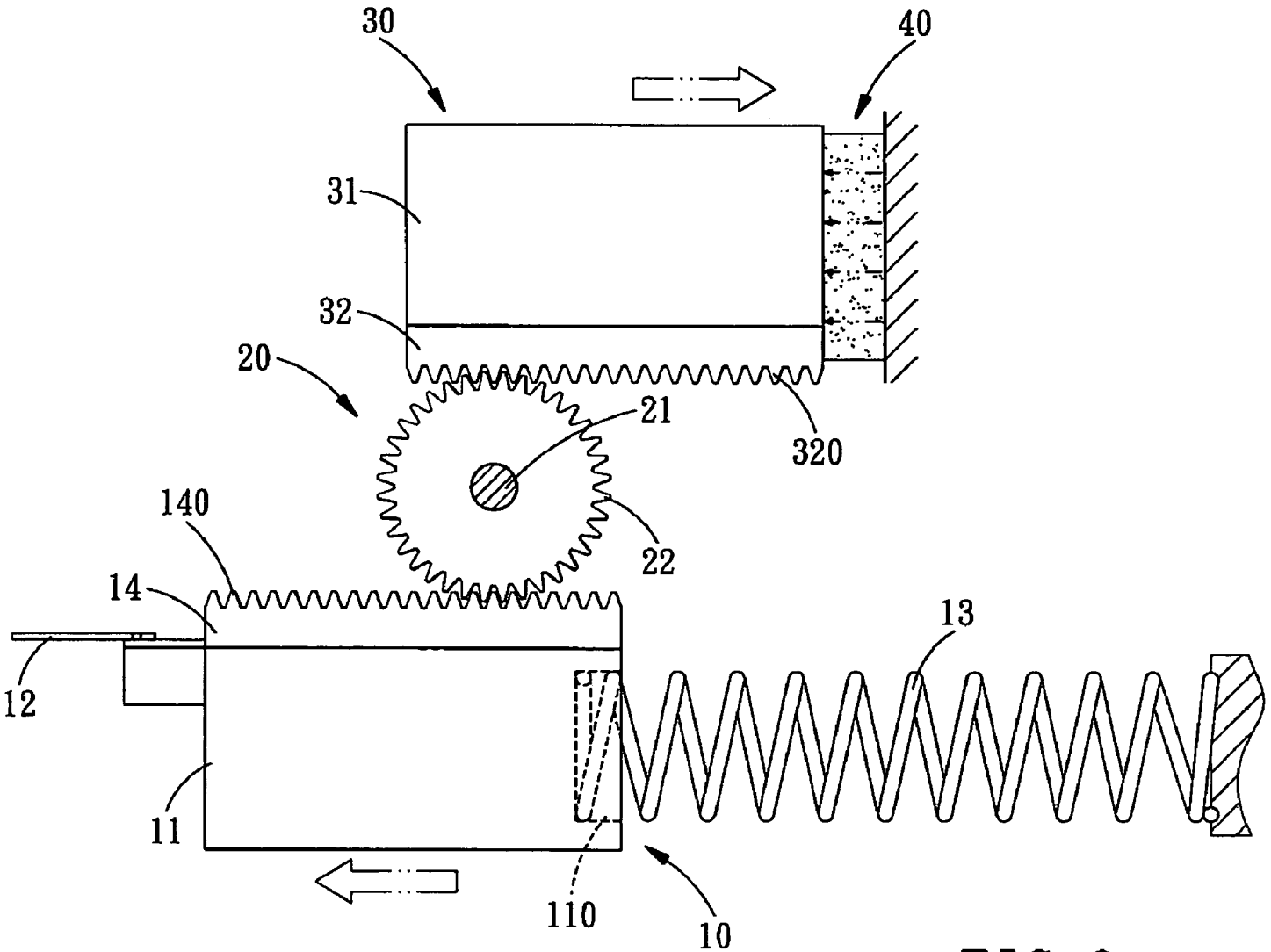
FIG. 2 is an illustrative view showing the counterforce-counteracting device for a nailer in accordance with the present invention.
Figure 3:
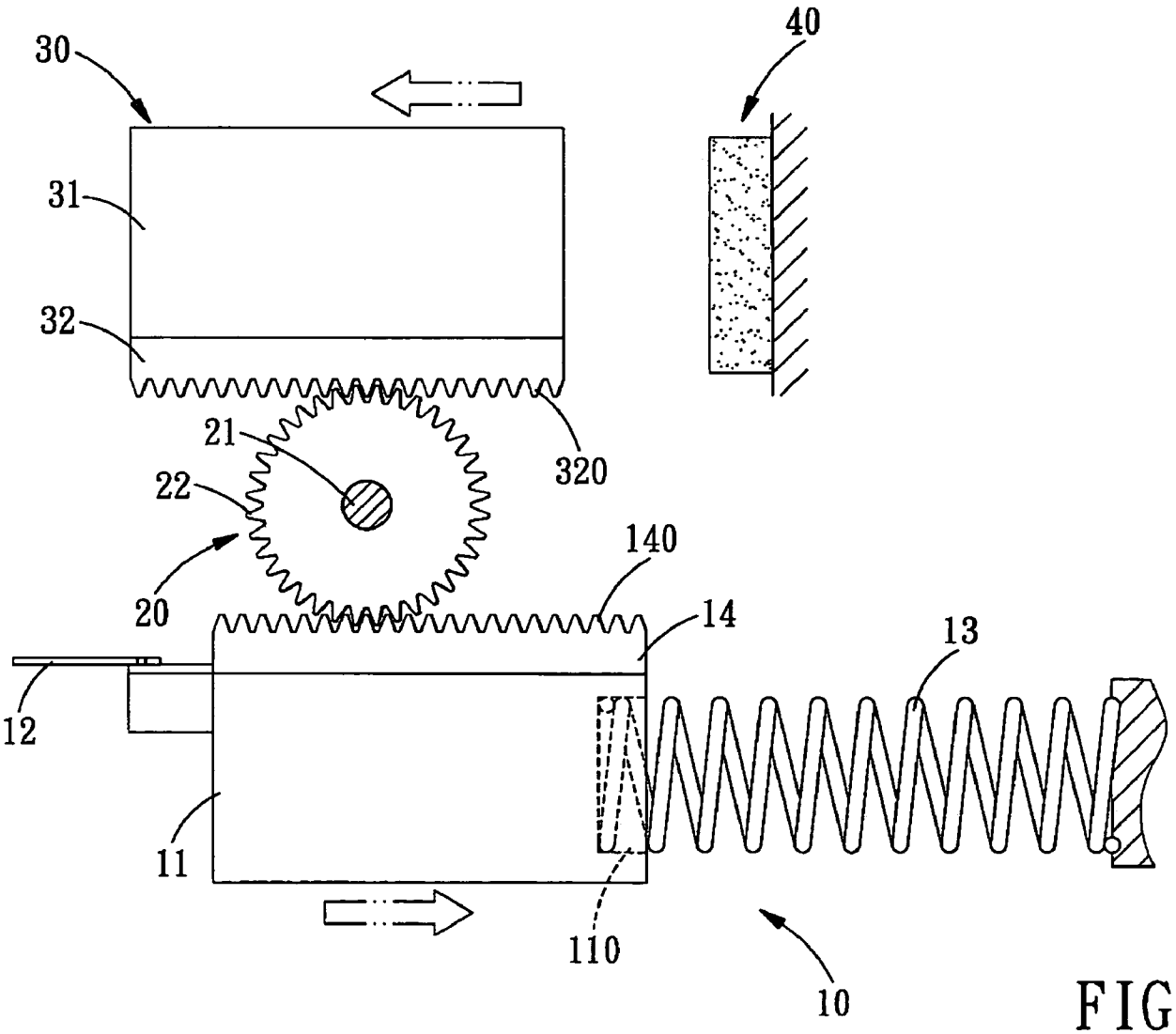
FIG. 3 is another illustrative view showing the counterforce-counteracting device for a nailer in accordance with the present invention.
Figure 4:
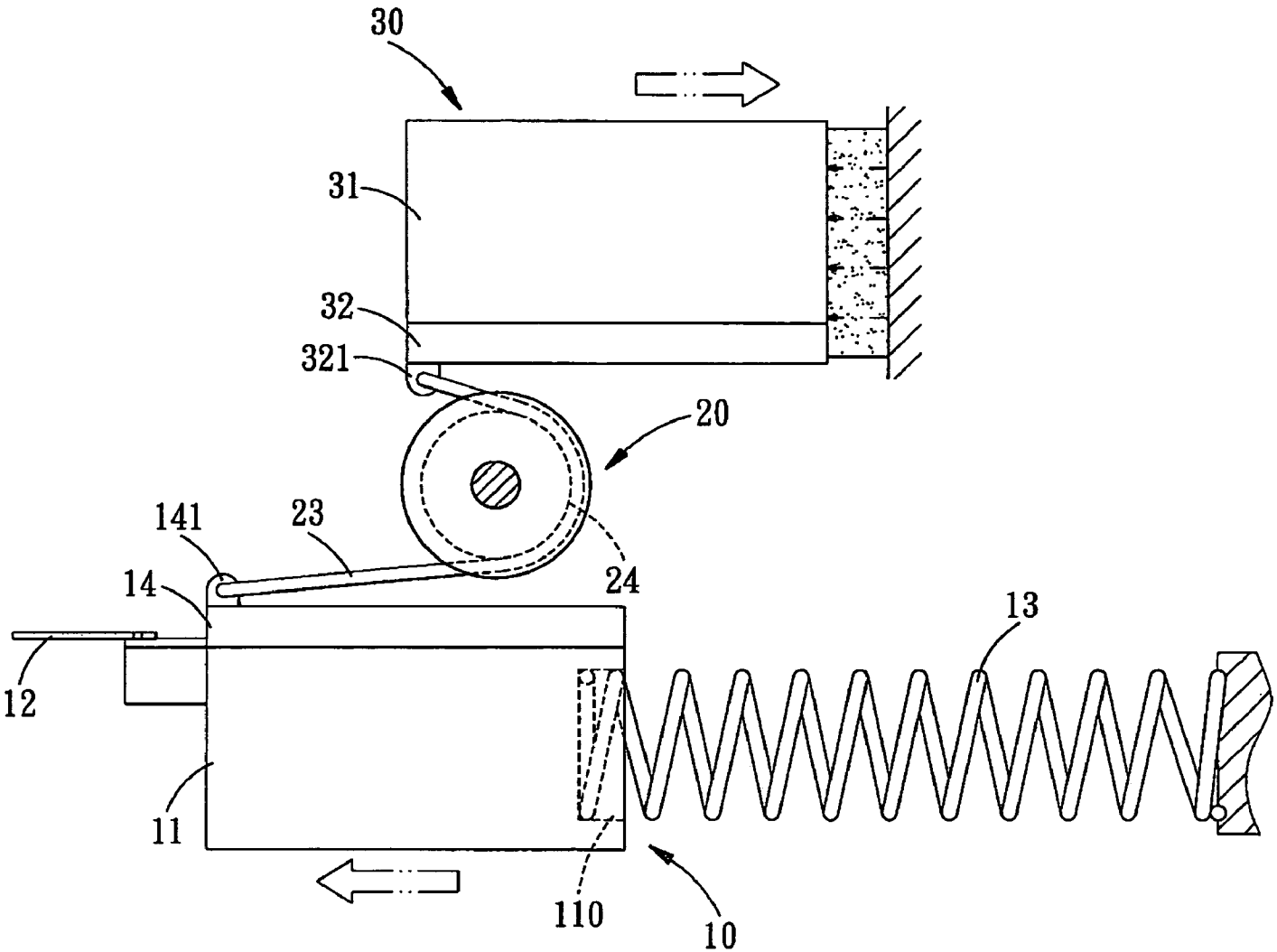
FIG. 4 is a perspective view of the counterforce-counteracting device for a nailer in accordance with a second embodiment of the present invention.

Referring to FIGS. 2 and 3, a counterforce-counteracting device for a nailer in accordance with a first embodiment of the present invention is shown, in normal condition, the active device 10 is located opposite to the weight device 30, and they are arranged one before the other as shown in FIG. 3. Referring to FIG. 2, when the active device 10 performs a striking motion, the active member 11 of the active device 10 moves towards one end thereof, and the nail-hitting member 12 strikes the nail into the object to be nailed. The first driving portion 140 of the first driving member 14 of the active member 11 drives the engaging portion 22 of the rotating member 20 to move, and then the engaging portion 22 of the rotating member 20 moves the second driving portion 320 of the second driving member 32 of the weight member 31, so as to produce a counterforce through the engagement rotation and to achieve the buffering effect. In addition, when the active member 11 returns to the normal condition after having performed the striking motion, the buffer member 40 will be abutted against the weight member 31 to produce the buffering effect again. By such arrangements, the present invention has double buffering effect.

Referring to FIG. 4 again, a counterforce-counteracting device for a nailer in accordance with a second embodiment of the present invention is shown, one end of the first driving member 14 of the active member 11 of the active device 10 is defined with a penetrated first positioning portion 141, and one end of the second driving portion 32 of the weight member 31 of the weight device 30 is defined with a penetrated second positioning portion 321 diagonally opposite the first positioning portion 141. The first positioning portion 141 of the first driving member 14 of the active member 11 and the second positioning portion 321 of the weight member 31 are provided for fixing a line-shaped pulling member 23, and the pulling member 23 winds around a containing portion 24 formed in the rotating member 20. The active device 10 cooperates with the weight device 30 to drive the pulling member 23 to move, enabling the pulling member 23 to extend and retract, such that the active device 10 and the weight device 30 can be used to produce a counterforce.

Figure 5:
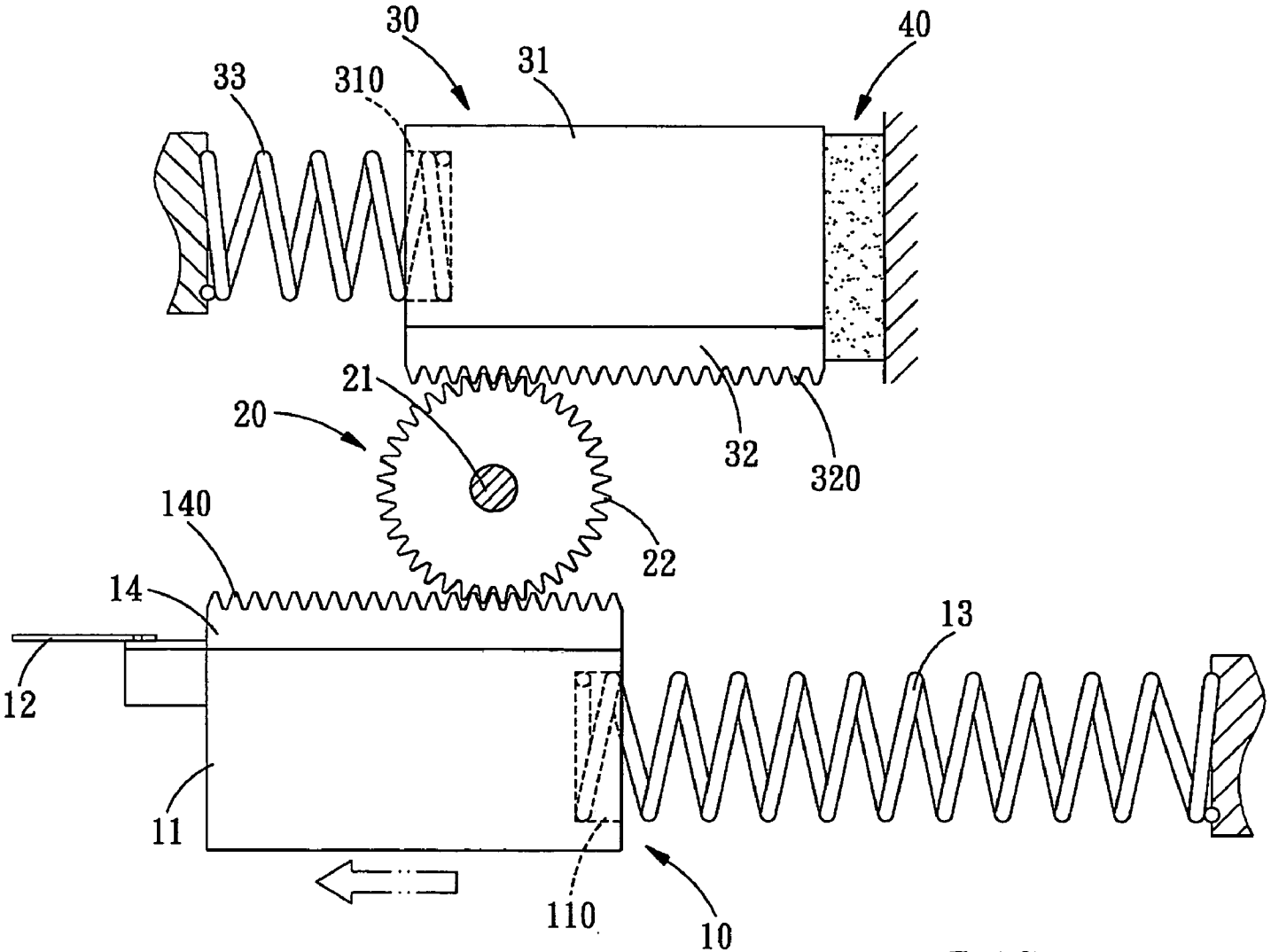
FIG. 5 is a perspective view of the counterforce-counteracting device for a nailer in accordance with a third embodiment of the present invention.

Referring to FIG. 5, a counterforce-counteracting device for a nailer in accordance with a third embodiment of the present invention is shown, one end of the weight member 31 of the weight device 30 is formed with a containing portion 310 for receiving one end of a second elastic member 33, and the other end of the second elastic member 33 is abutted against the inside of the nailer. When the active device 10 performs a striking motion, the active member 11 of the active device 10 moves towards one end thereof, and the nail-hitting member 12 strikes the nail into the object to be nailed. The first driving portion 140 of the first driving member 14 of the active member 11 drives the engaging portion 22 of the rotating member 20 to move, and then the rotating portion 22 of the rotating member 20 moves the second driving portion 320 of the second driving member 32. In addition, after the second elastic member 33 received in the containing portion 310 of the weight member 31 produces a push force after having performed the striking motion, the weight member 31 of the weight device 30 will produce an inertia force opposite to the push force. In addition, the push force produced by the second elastic member 33 can reduce the loss of the inertia force of the weight member 31 of the weight device 30. Thereby, the present invention is secure and can hit the nail stably.

It is apparent from the above-mentioned descriptions that the present invention has the advantages described as follows:

Firstly, since the active device 10 drives the rotating member 20 to move, then the rotating member 20 moves the weight device 30, and the buffer member 40 is disposed at a free end of the weight device 30, the structure of the present invention is simple.

Secondly, the active device drives the rotating member 20 to move, and then the rotating member 20 moves the weight device 30, the active device 10 is located opposite to the weight device 30, and they are arranged one before the other, so as to produce a counterforce and to achieve the buffering effect. In addition, when the active member 11 returns to the normal condition after having performed the striking motion, the buffer member 40 will be abutted against the weight member 31 to produce the buffering effect again. Thereby, the present invention has double buffering effect and is secure.

Thirdly, since the present invention has double buffering effect, the nailer has high stability.

Fourthly, with the relative position of the elastic member 13 received in the containing portion 110 of the active member 11 and the second elastic member 33 received in the containing portion 310 of the weight member 31, and after the second elastic member 33 produces a push force after having performed the striking motion, the weight member 31 of the weight device 30 will produce an inertia force opposite to the push force. In addition, the push force produced by the second elastic member 33 can increase the inertia force of the weight member 31 of the weight device 30. Thereby, the inertia force of the present invention is increased.

While we have shown and described various embodiments in accordance with the present invention, it should be clear to those skilled in the art that further embodiments may be made without departing from the scope of the present invention.

What is claimed is:

1. A counterforce-counteracting device for a nailer, comprising:

an active device disposed in the nailer and including an active member and at least one first driving member, the first driving member being located at one side of the active member;

a rotating member pivotally disposed in the nailer and moved by the first driving member of the active member;

a weight device disposed in the nailer and including a weight member and at least one second driving member, the second driving member being located at one surface of the weight member facing the rotating member and driven by the rotating member;

when the active device being moving, the first driving member of the active member driving the rotating member to move, and then the rotating member moving the second driving member of the weight member of the weight device, enabling the active device and the weight device to produce a counterforce, and the weight device being used to produce a counterforce to counteract a counterforce produced by the active device.

2. The counterforce-counteracting device for a nailer as claimed in claim 1, wherein the active device includes the active member, a nail-hitting member, a first elastic member, and two first driving members, the active member is disposed in the nailer, the nail-hitting member is located at one end of the active member close to a muzzle of the nailer and is provided for hitting the nail into a work piece, an other end of the active member is formed with a containing portion for receiving one end of the first elastic member, an other end of the first elastic member is abutted against an inside of the nailer, the first driving members are located at one end of the active member facing the rotating member, each first driving member is formed with a first driving portion serves to drive the rotating member to move.

3. The counterforce-counteracting device for a nailer as claimed in claim 1, wherein the rotating member includes a pivot member and at least one engaging portion, the pivot member is inserted into the rotating member from one side of the nailer, the rotating member is rotated around the pivot member, the engaging portion is rotated by the first driving portion of the first driving member of the active member and then drives the weight device to move.

4. The counterforce-counteracting device for a nailer as claimed in claim 1, wherein the weight device includes the weight member and two second driving members, the weight member is disposed in one end of the nailer close to the rotating member, the second driving member is located at one side of the weight member close to the rotating member, each second driving member is formed with a second driving portion for engaging with the engaging portion of the rotating member.

5. The counterforce-counteracting device for a nailer as claimed in claim 1, wherein an buffer member is disposed in one end of the nailer close to the active device and is abutted against the weight member, the buffer member is made of flexible material that can absorb shock and stress, such as soft pad, plastic, rubber, and cork.

6. The counterforce-counteracting device for a nailer as claimed in claim 1, wherein one end of the first driving member of the active member of the active device is defined with a first positioning portion, one end of the weight member of the weight device is defined with a second positioning portion diagonally opposite the first positioning portion, the first positioning portion of the first driving member of the active member and the second positioning portion of the weight member are provided for fixing a pulling member, the pulling member winds around a containing portion formed in the rotating member, the active device cooperates with the weight device to drive the pulling member to move, enabling the pulling member to extend and retract, such that the active device and the weight device are used to produce a counterforce.

7. The counterforce-counteracting device for a nailer as claimed in claim 1, wherein one end of the weight member of the weight device is formed with a containing portion for receiving one end of a second elastic member, and an other end of the second elastic member is abutted against an inside of the nailer.

* * * * *